United States Patent [19]

Blanchard

[11] Patent Number: 4,660,750

[45] Date of Patent: Apr. 28, 1987

[54] GARMENT HANGER WITH IMPROVED WIRE SUPPORT

[75] Inventor: Russell O. Blanchard, Zeeland, Mich.

[73] Assignee: Batts, Inc., Zeeland, Mich.

[21] Appl. No.: 893,184

[22] Filed: Aug. 5, 1986

Related U.S. Application Data

[62] Division of Ser. No. 790,492, Oct. 23, 1985.

[51] Int. Cl.[4] ..... A41D 27/22

[52] U.S. Cl. ..... 223/91; 24/501; 211/124; D6/328

[58] Field of Search ..... 223/85, 88, 91, 92, 223/93, 95, 96, 97, 98; 24/501, 532; 248/340; 211/124, 115; D6/328

[56] References Cited

U.S. PATENT DOCUMENTS

| | | | |
|---|---|---|---|
| 1,447,083 | 2/1923 | Jonas | 223/85 X |
| 2,583,784 | 1/1952 | MacCaferri | 223/91 |
| 3,456,262 | 7/1969 | Coon | 24/501 |
| 3,950,829 | 4/1976 | Cohen | 223/91 X |
| 4,335,838 | 6/1982 | Bisk et al. | 223/93 X |
| 4,395,799 | 8/1983 | Batts | 223/96 X |

*Primary Examiner*—Werner H. Schroeder
*Assistant Examiner*—Andrew M. Falik
*Attorney, Agent, or Firm*—Price, Heneveld, Cooper, DeWitt & Litton

[57] ABSTRACT

An article hanger of the type having an elongated body with dependent arms mounting article gripping clamps and rod support means which permits the rod to be assembled to the hanger body through a face of the body after the hanger has been molded. The support means includes a member for locking the rod into its supporting means in a manner preventing unintentional release. The hanger body also includes a third support for the rod to reduce load induced deflection. Article clamps for the hanger are so designed that they can either be mounted on the rod before assembly of the rod to the hanger body or the clamps can be assembled about the rod after installation of the rod on the hanger body.

5 Claims, 13 Drawing Figures

GARMENT HANGER WITH IMPROVED WIRE SUPPORT

CROSS REFERENCE TO RELATED APPLICATIONS

This is a division of application, Ser. No. 790,492 filed Oct. 23, 1985 pending.

FIELD OF THE INVENTION

This invention relates to article hangers, primarily those used for garments. The hanger is of the type having a body to which a wire rod is attached, slidably mounted on which are article gripping clips.

BACKGROUND OF THE INVENTION

Article hangers having an elongated body serving as a beam with depending end portions connected by a wire rod have been known and used for years. An example of this type of hanger is disclosed in U.S. Pat. No. 2,583,784 issued Jan. 29, 1952 to Maccaferri. The rod is unsupported for almost its entire length since it is supported only at its ends. This materially limits the weight which can be supported from the rod unless the rod is relatively thick, a feature considered undesirable in article hangers from both the standpoint of cost and that of appearance. Further, the rod has to be inserted in the hanger mold or inserted from one end through a suitable opening in one of the hanger's dependent legs. Neither of these are satisfactory arrangements, particularly from the standpoint of manufacturing cost. The use of the heavy rod to avoid load deflection is also unsatisfactory from the point of weight.

Another problem has been development of a satisfactory article grip. Heretofore, these gripping or clamping devices have either gripped the articles with such force as to mark the articles or have not had adequate gripping force to dependably hold the articles, particularly, heavy articles against unwanted release, particularly under the effects of vibration, rough handling or the conditions normallY experienced in transport. Not only is providing an adequate grip important, it is also important to be able to mount and dismount the article clamp from the rod without having to detach the rod from the hanger body.

BRIEF DESCRIPTION OF THE INVENTION

A hanger is provided with an elongated body having a pair of depending ends. A rod interconnects the ends providing a support for articles such as clothing. Intermediate the ends, preferably midway between them, the hanger has a leg forming a third rod support, thereby greatly reducing the bending movement applied to the rod. Both ends and the third rod support are so designed that the rod can be assembled to the hanger body through one face of the body after the body has been molded, eliminating the necessity of either securing the rod during molding or, after molding, inserting it from one end of the hanger. Also, the rod receiving opening has rod locking means, securing the rod against being inadvertently separated from the hanger body. The article gripping clamp has been designed to be mountable on and removable from the rod after the rod has been mounted on the hanger body.

DESCRIPTION OF THE DRAWINGS

Referring to FIG. 1, the numeral 10 refers to an article hanger having an elongated, molded plastic body 11. The body 11 has a depending end or leg 12 at each end and a dependent center leg 13 midway between the legs 12. Above the center leg 13 a boss 14 mounts a hook 15 for supporting the hanger. While the hook 15 is illustrated as formed of wire and rotatably secured to the body, it could be molded integral with the body. The body 11 is preferably of conventional I-beam design having top and bottom horizontal flanges joined by a vertical web. Other body designs can also be used.

Figure 1:
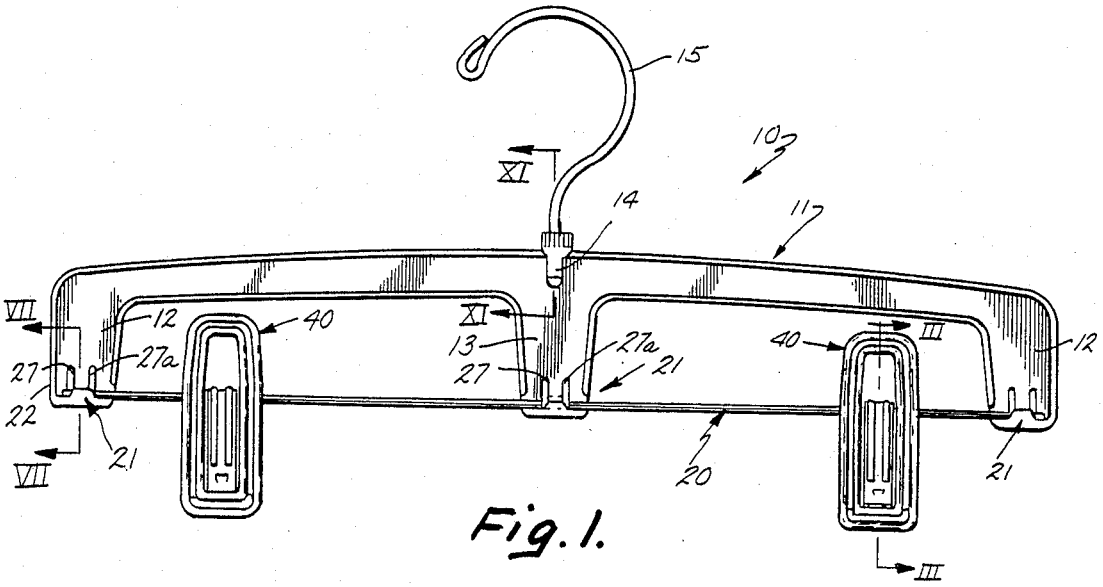
FIG. 1 is a front elevation view of the assembled hanger.
Figure 2:
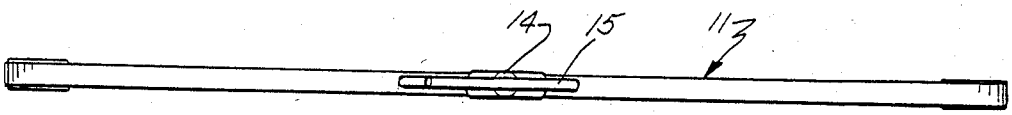
FIG. 2 is a top view of the hanger without the clamps.

Mounted to the end legs 12 and center leg 13 is a rod 20. The rod 20 is preferably a length of thin metal rod or wire. At each of the legs it is seated in a pocket 21. The pockets 21 are of the same construction except the seat for the rod 20 in each of the end legs is closed at the outer end by the reinforcement flange 22.

Figure 7:
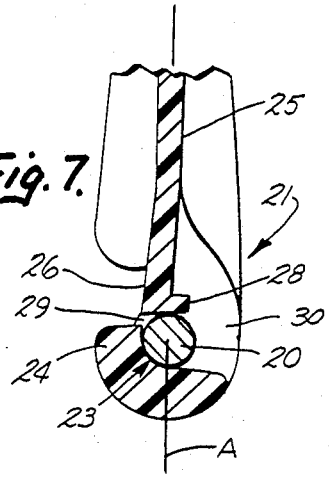
FIG. 7 is an enlarged fragmentary sectional view taken along the plane VII—VII of FIG. 1.
Figure 8:
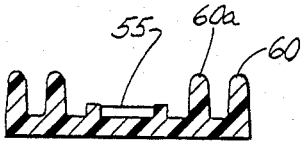
FIG. 8 is a sectional view taken along the plane VIII—VIII of FIG. 5.
Figure 12:
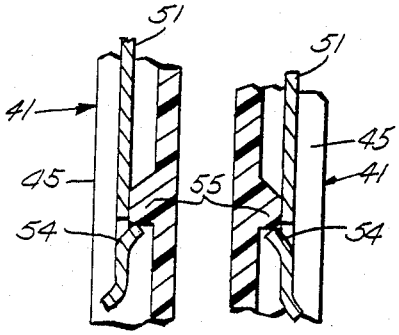
FIG. 12 is an enlarged fragmentary view of the attachment of the spring to the clamp body.
Figure 11:
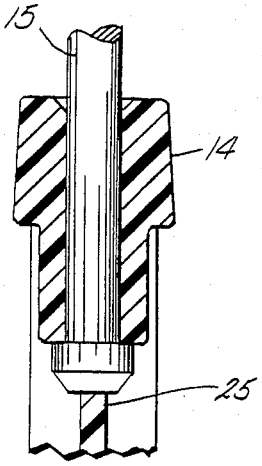
FIG. 11 is an enlarged fragmentary sectional view taken along the plane XI—XI of FIG. 1.

Referring to FIG. 7 it will be seen that the pocket 21 is formed by shaping the lower end of the leg into a generally J-shaped hook having a rod seat 23 with an upstanding front lip 24. To center the rod seat 23 about the central plane A of the web 25 of the lower portion of the leg the web is offset rearwardly as it starts to form the rod seat 23. Above the rod seat 23 the web 21 has a downwardly extending, slightly forwardly inclined tongue 26 separated from the rearwardly offset portion of the web by a pair of vertical slots 27 and 27*a* (FIG. 1). The bottom end of the tongue has a rearwardly extending finger 28. The lower face of the finger 28 is spaced from the top of the lip 24 a distance less than the diameter of the rod 20, creating a throat or passage 29. Preferably, the lower face of the finger 28 is slightly upwardly inclined in a direction away from the throat 29. Because the hanger is molded of plastic, the tongue has a degree of resilience and thus can be deflected sufficiently to permit the rod 20 to be passed through the passage 29. Once the rod is seated in the pocket, the resilience of the tongue will return it to its original position, locking the rod in its seat. This construction is the same for all three legs. By virtue of this construction the rod can be assembled to the hanger after molding of the body is complete. It also, permits the rod to be assembled from the front of the hanger rather than from the ends and thus its installation can be automated. Further, this construction eliminates the need for movable cams in the mold since the rear face of the pocket is open at 30 between the slots 27 and 27*a*. It will be recognized that while the pockets are described as opening to the front of the hanger, the design can be changed to open the pockets to the rear.

Figure 10:
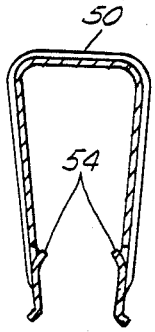
FIG. 10 is an end view of the spring clip for closing the article clamp.
Figure 9:
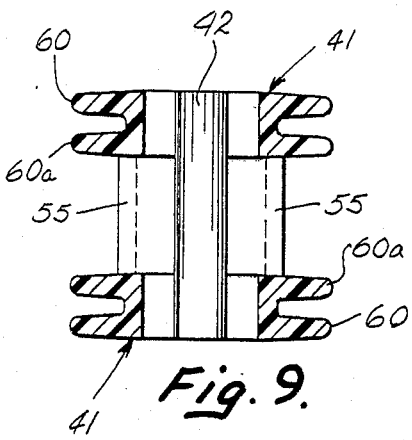
FIG. 9 is an enlarged fragmentary sectional view taken along the plane IX—IX of FIG. 6.

The body of the clamp 40 is generally H-shaped, as seen from the side (FIGS. 3, 3*a*, 4 and 6). It has a pair of wings 41 joined by a relatively thin, flexible web 42. The wings 41 on one side of the web provide a pair of handles 43 for manipulating the clamp. On the other side of the web 42 the wings 41 define an article receiving pocket 44 between the gripping arms 45. Between the pocket 44 and the web 42 are two pairs of inwardly extending ribs 46 and 47 which, between them, define the rod receiving opening 48. The rib pair 46 separates the rod opening 48 from the article pocket 44 and the rib pair 47 separates the rod opening 48 from the space 49 within the connecting web 25. As will be seen in FIG. 3, when the clamp is closed the ribs of the rib pair 46 abut or almost abut and when the clamp is fully open the ribs of the rib pair 47 abut or almost abut. The rod opening is so sized that the rod 20 serves as the pivot for the wings 41. The wings 41 are biased into closed or clamping position by the spring 50, FIGS. 3, 3*a* and 10. The spring has a pair of arms 51 joined by a flat web 52. The length of the arms 51 is such that their ends extend substantially to the free ends of the gripping arms 45 and hold the spring web 52 away from connecting web 42 so that in no position of the clamp is there contact between the connecting web 42 and the spring 50. For stiffness, the spring has a pair of ribs 53 extending lengthwise of it. The free ends of the spring are turned outwardly to facilitate installation. Adjacent the free ends each spring has an inwardly bent tab 54 which engages behind a suitable stop 55 (FIGS. 5, 8, 10 and 12) to prevent release of the spring once it has been installed. Each of the stops 55 has an inclined face directed toward the connecting web 42 to facilitate installation of the spring.

Figure 3:
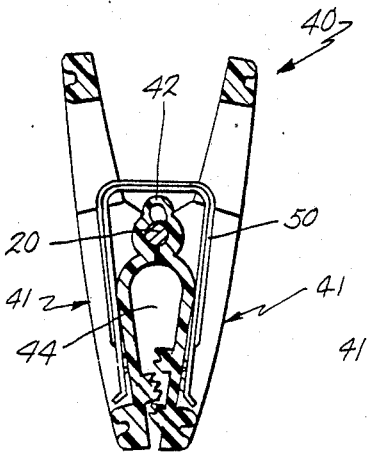
FIG. 3 is a sectional view of one of the article clamps taken along plane III—III of FIG. 1, illustrating the clamp in closed position.
Figure 3A:
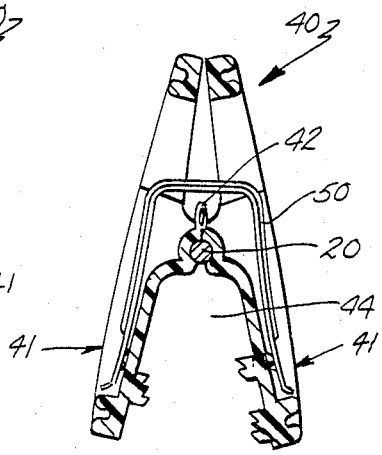
FIG. 3*a* is a view similar to FIG. 3 but showing the article clamp in open position.
Figure 4:
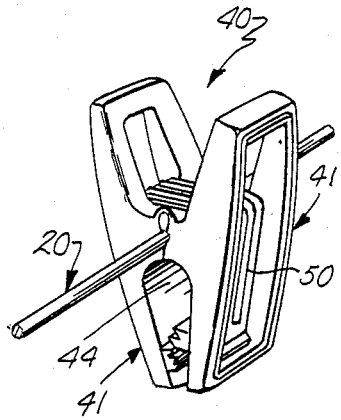
FIG. 4 is an oblique view of one of the article clamps.
Figure 5:
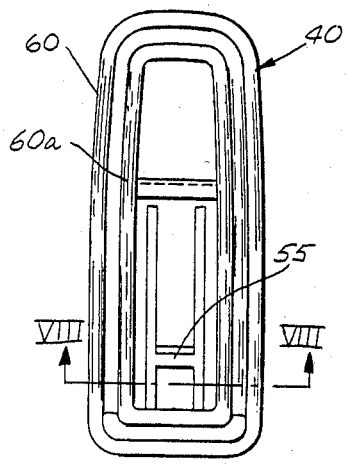
FIG. 5 is a front view of one of the article clamps.
Figure 6:
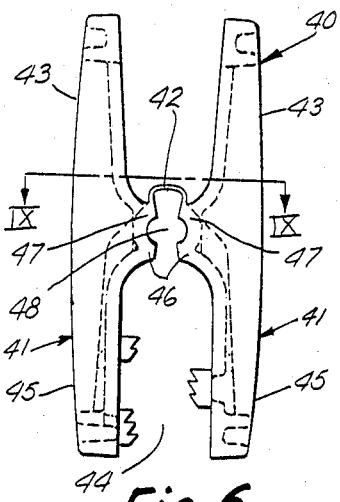
FIG. 6 is an end view of one of the clamps before installation of the spring.

The wings have a pair of spaced parallel ribs 60 and 60*a* which form their entire perimeter. These ribs are deepest adjacent the rod opening 48. The centers of the handle portions of the wings are open to permit installation of the spring 50. The spring and body of the clamp can be assembled and then the clamp mounted on the rod 20. This is possible because the spring can be opened further than is illustrated in FIG. 3*a* to pass the rod 20 between the ribs of the rib pair 46. As an alternative procedure, the body of the clamp connecting of the wings 41 and connecting web 42 can be seated over the rod and the spring then installed on the clamp. In either case, the connecting web holds the wings together prior to installation of the spring. Once the spring has been installed the function of the connecting web 42 is solely to aid in maintaining alignment between the individual halves of the rings. For this purpose it will be noted from FIG. 6 that the connecting web extends the entire width of the clamp.

The invention materially increases the capacity of the hanger without having to increase rod diameter. By reducing the effective beam length of the rod the weight which can be supported without deflecting the rod permanently or even temporarily is significantly increased. The hanger can withstand substantially greater abuse and rough handling than was heretofore possible. Because the rod can be removed without physically damaging either the rod of the hanger body, the rod and or the clamps can be replaced. In addition, the clamps because of this construction, can be individually removed from the rod and replaced. All this is accomplished without adding any material cost other than for the small amount of plastic required for the center leg 13.

The body 11 of the hanger can be molded from any suitable plastic such for example as polystyrene or polypropylene. The clamp can be molded from materials having the proper characteristics of stiffness for the body of the wings and resistance to fatigue for the connecting web 42. A suitable material for this purpose is polypropylene.

Having described a preferred embodiment of this invention, it will be recognized that various modifications of it can be made without departing from the principles of the invention. Such modifications are to be considered as included in the hereinafter appended claims, unless the language of the claims expressly states otherwise.

I claim:

1. A hanger for articles, said hanger having a rigid elongated body, the ends of said body extending downwardly to form a pair of depending legs; a rod of circular cross-section extending between the lower ends of said legs; means securing said rod to each of said legs, a clamp for mounting on said rod, said clamp having a pair of wings integral with and connected by a flexible web intermediate the ends of said wings; a first pair of inwardly extending ribs; a second pair of inwardly extending ribs; said pairs of ribs being spaced and between them defining a rod receiving opening of lesser diameter than said rod; said wings between said second pair of ribs and one end thereof defining an article receiving pocket; a spring urging said wings to close said pocket and said ribs of said second pair into contact with each other; said wings, when said article receiving pocket is opened, pivoting about the rod to bring the ribs of said first pair into contact with each other; said connecting web being formed into a loop extending away from the article receiving pocket.

2. A hanger for articles as described in claim 1 wherein said spring is generally U-shaped having a pair of arms joined by a flat connecting piece, the length of said arms being such that said loop is contained within and free of contact with said spring at all times.

3. A hanger for articles as described in claim 1 wherein said spring is generally U-shaped having a pair of arms substantially overlying that portion of said wings enclosing said article receiving pocket, said spring being substantially narrower than said wings; that portion of said wings extending away from said rod opening oppositely from said article receiving pocket having a central open portion to permit installation of said spring.

4. A hanger for articles as described in claim 1 wherein said loop extends the entire width of said wings and supports them against misalignment with respect to each other about their longitudinal axes.

5. A hanger for articles as described in claim 4 wherein said ribs offset said rod receiving opening substantially inwardly from the plane of the inside faces of both of said wings; said rod receiving opening defined by said ribs being smaller than said rod to permit said ribs to move circumferentially about the rod when the wings are pivoted between open and closed positions whereby said clamp at all times grips the rod to resist sliding movement therealong.

* * * * *